US005994020A

United States Patent [19]

Patel et al.

[11] Patent Number: 5,994,020

[45] Date of Patent: Nov. 30, 1999

[54] WAX CONTAINING COLORANTS

[75] Inventors: Raj D. Patel, Oakville; Michael A. Hopper; Paul F. Smith, both of Toronto; Beng S. Ong, Mississauga; Allan K. Chen, Oakville, all of Canada

[73] Assignee: Xerox Corporation, Stamford, Conn.

[21] Appl. No.: 09/058,738

[22] Filed: Apr. 13, 1998

[51] Int. Cl.[6] ..... G03G 9/087

[52] U.S. Cl. ..... 430/137

[58] Field of Search ..... 430/110, 111, 430/137

[56] References Cited

U.S. PATENT DOCUMENTS

| | | | |
|---|---|---|---|
| 4,996,127 | 2/1991 | Hasegawa et al. | 430/109 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,482,812 | 1/1996 | Hopper et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,650,255 | 7/1997 | Ng et al. | 430/137 |
| 5,650,256 | 7/1997 | Veregin et al. | 430/137 |
| 5,858,596 | 1/1999 | Tajima et al. | 430/137 |

*Primary Examiner*—John Goodrow
*Attorney, Agent, or Firm*—E. O. Palazzo

[57] ABSTRACT

A toner process which comprises mixing (i) a colorant dispersion, and a (ii) a nonionic surfactant, an ionic surfactant or mixtures thereof, with (iii) a latex comprised of resin and a mixture of anionic surfactant and a nonionic surfactant;

(iv) heating the resulting blend of (iii) about equal to, or below about the glass transition temperature (Tg) of the resin; and (v) optionally adding additional anionic surfactant to the resulting aggregated suspension of (iv);

(vi) heating the resulting mixture of (v) about equal to, or above about the Tg of the resin and (vii) isolating the toner.

38 Claims, No Drawings

WAX CONTAINING COLORANTS

BACKGROUND OF THE INVENTION

The present invention is generally directed to toners, and toner processes, and more specifically to wax containing colorants, and aggregation and coalescence processes for the preparation of toner compositions. In embodiments, the present invention is directed to the economical chemical insitu preparation of toners, and wherein toner compositions with an volume average diameter of from about 1 to about 25, and preferably from 1 to about 10 microns in volume average diameter and narrow GSD of, for example, from about 1.15 to about 1.25 as measured on the Coulter Counter can be obtained, and which toners contain an optional non functionalized wax component, such as a low molecular weight wax, with from for example, a Mw of from about 800 to about 20,000, (about includes values in between throughout) and further containing modified functional waxes, such as polyalkylenes, like suitable polyethylenes, and polypropylenes, or hydrocarbons, each containing functional groups such as halide, like fluorine, amide imides, esters, quaternary amines, carboxylic acid, mixtures thereof, and the like on the polymer backbone, thereby permitting for example, substantial complete incorporation of the functionalized wax into the toner particles. The functionalized waxes selected and present in various suitable amounts, such as from about 1 to about 20, and preferably from about 2 to about 10 weight percent are available from a number of sources, such as Petrolite, Dow Corning, E. I. DuPont, S.C. Johnson Wax, and Sanyo Chemicals of Japan. The complete total functionalized wax incorporation (contrasted to of less than complete incorporation, for example from about 20 to about 40 percent incorporation of the nonfunctionalized waxes of the prior art resulting in release and stripping problems during image and toner fusing) into a host toner resin is important for release purposes when such toners are selected for known electrophotographic imaging processes.

With the processes of the present invention in embodiments, small average toner particle sizes of, for example, from about 3 microns to about 12, and preferably about 5 microns result without resorting to classification processes, and wherein narrow toner geometric size distributions are achievable, such as from about 1.16 to about 1.30, and preferably from about 1.16 to about 1.25. High toner yields are also obtainable with the processes of the present invention, such as from about 90 percent to about 98 percent.

In reprographic technologies, such as xerographic and ionographic devices, toners with volume average diameter particle sizes of from about 9 microns to about 20 microns are effectively utilized. Moreover, in some xerographic technologies, such as the high volume Xerox Corporation 5090 copier-duplicator, high resolution characteristics and low image noise can be attained utilizing the small sized toners of the present invention with, for example, an volume average particle of from about 2 to about 12 microns and preferably less than about 7 microns, and with narrow geometric size distribution (GSD) of from about 1.16 to about 1.3. Additionally, in some xerographic systems wherein process color is utilized, such as pictorial color applications, small particle size colored toners, preferably of from about 3 to about 9 microns, are needed to avoid paper curling. Paper curling is especially observable in pictorial or process color applications wherein three to four layers of toners are transferred and fused onto paper. During the fusing step, moisture is driven off from the paper due to the high fusing temperatures of from about 130 to 160° C. applied to the paper from the fuser. Where only one layer of toner is present, such as in black or in highlight xerographic applications, the amount of moisture driven off during fusing can be reabsorbed proportionally by the paper and the resulting print remains relatively flat with minimal curl. In pictorial color process applications wherein three to four colored toner layers are present, a thicker toner plastic level present after the fusing step can inhibit the paper from sufficiently absorbing the moisture lost during the fusing step, and image paper curling results. These and other disadvantages and problems are avoided or minimized with the toners and processes of the present invention.

Lower toner fusing temperatures, such as about 120 to about 150 degrees Centigrade, and which fusing temperatures can be achievable with the toners of the present invention, minimize the loss of moisture from paper, thereby reducing or eliminating paper curl. Furthermore, in process color applications and especially in pictorial color applications, toner to paper gloss matching is important. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns and fixing thereafter, results in a low gloss toner image of from about 1 to about 30 gloss units as measured by the Gardner Gloss metering unit. Alternatively, when higher image gloss is to be generated, such as from about 30 to about 60 gloss units as measured by the Gardner Gloss metering unit, higher gloss paper is utilized, such as from about 30 to about 60 gloss units, and which after image formation with small particle size toners of the present invention of preferably from about 3 to about 5 microns and fixing thereafter results in a higher gloss toner image of from about 30 to about 60 gloss units as measured by the Gardner Gloss metering unit. The aforementioned toner to paper matching can be preferably attained with small particle size toners such as equal to or less than about 7 microns and preferably about 5 microns, and more preferably from about 1 to about 4 microns, whereby the pile height of the toner layer or layers is considered low.

PRIOR ART

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent.

Waxes such as non functionalized polypropylene or polyethylene when incorporated into the toner formulation exhibit wax rejection in the range of about 40 to about 70 weight percent into the aqueous phase, and these toners when fused exhibit poor release, primarily caused by the low concentration of wax. Generally when a wax is added to a resin/colorant mixture by conventional process during melt mixing in a Banbury or extruder, a compatabilizer is usually added to the toner to ensure that an acceptable wax dispersion in the host toner resin. If the wax is not well dispersed in the toner resin, large domains of wax form in the resin-wax blend, and which domains of wax can be larger than about 10 microns in diameter, thus when subjected to pulverization and jetting the resin/colorant/wax blend some of the toner particles contain only wax and colorant, and further, free wax forms and can escape. Free wax is known to cause dramatic changes in the toner flow behavior and the toner triboelectricals. In contrast, toners generated by the processes of the present invention, and with functionalized waxes, avoids, or minimizes wax release and toner wax rejection, thus the use of functionalized waxes and waxes with low affinity to water and high affinity for the toner resin/latex is of importance. More specifically, the use of functionalized waxes, wherein the wax is introduced in a form of a dispersion containing submicron wax particles in the diameter size range of about 0.05 to about 0.5 and preferably about 0.1 to about 0.3 microns and wherein the wax particles size may also be in the same size range as the host resin and colorant avoids some of the prior art problems, and also, a compatabilizer is not needed.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, it is indicated in column 9, lines 50 to 55, that a polar monomer, such as acrylic acid, in the emulsion resin is necessary, and toner preparation is not obtained without the use, for example, of acrylic acid polar group, see Comparative Example I.

In U.S. Pat. No. 5,482,812, the disclosure of which is totally incorporated herein by reference, there is illustrated toner processes with nonfunctionalized waxes, such as polypropylene and polyethylene, and more specifically this patent discloses a process for the preparation of toner compositions comprising:

(i) preparing a pigment dispersion in water, which dispersion is comprised of pigment, a counterionic surfactant with a charge polarity of opposite sign to the anionic surfactant of (ii) surfactant and optionally a charge control agent, and providing a wax dispersion in a certain surfactant;

(ii) shearing the resulting dispersions with a latex comprised of resin, anionic surfactant, nonionic surfactant, and water; and wherein the latex solids content, which solids are comprised of resin, is from about 50 weight percent to about 20 weight percent, and causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5 to about 25° C. below about the glass transition temperature (Tg) of the resin while continuously stirring to form toner sized aggregates with a narrow size dispersity; and (iv) heating the resulting electrostatically bound aggregated particles at a temperature of from about 5 to about 50° C. above about the Tg of the resin to provide a toner composition comprised of resin, pigment and optionally a charge control agent. When the waxes of this patent, especially polypropylene and polyethylene and when the temperature of the coalescence is for example, in excess of about 0 degrees Centigrade for an extended period time of for example, greater than about one hour, there results wax rejection. This is primarily caused by the wax particles which are molten at these temperature, and therefore mobile and free to move and migrate to the surface of the toner aggregate particles and into the water phase. The waxes of the 5,482,812 patent may be selected as a second wax in the present invention in embodiments.

Emulsion/aggregation processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners). The appropriate components and processes of these Xerox patents may be selected for the present invention in embodiments thereof.

SUMMARY OF THE INVENTION

It is an feature of the present invention to provide toner processes with many of the advantages illustrated herein.

Moreover, in a further feature of the present invention there is provided a process for the preparation of toner compositions which after fixing to paper substrates results in images with a gloss of from about 20 GGU (Gardner Gloss Units) to about 70 GGU as measured by Gardner Gloss meter matching of toner and paper.

In another feature of the present invention there is provided a composite toner of polymeric resin with colorant and functionalized wax, which wax can function as a toner tribo enhancer, and which toner is obtainable in high yields of from about 90 percent to about 100 percent without resorting to classification.

In yet another feature of the present invention there are provided toner compositions containing a functionalized wax component and which toner has a low fusing temperature of for example, from about 110° C. to about 150° C., excellent toner blocking characteristics at from about 50° C. to about 60° C. and excellent release characteristics, especially from fuser rolls present in electrostatic imaging systems.

Moreover, in another feature of the present invention there are provided toner compositions with a high projection efficiency, such as from about 75 to about 95 percent efficiency as measured by the Match Scan II spectrophotometer available from Milton-Roy.

In a further feature of the present invention there are provided toner compositions which result in minimal, low or no paper curl.

Another feature of the present invention resides in processes for the preparation of small sized toner particles with narrow GSDs, and excellent colorant dispersions by the aggregation of latex particles with colorant particles dispersed in water and a surfactant, and wherein the aggregated particles of toner size can then be caused to coalesce and fuse by, for example, heating.

Further, in another feature of the present invention there are provided colorant dispersions containing functionalized waxes, and which dispersion can be selected for the preparation of toners, preferably by the emulsion/aggregation processes illustrated in the appropriate Xerox patents recited herein, and wherein the functionalized waxes can function as a colorant passivating agent encapsulating the colorant for example, and as a toner release agent.

These and other features of the present invention are accomplished in embodiments by the provision of waxy toners and processes thereof. More specifically, the present invention is directed to processes for the economical direct preparation of toner compositions by flocculation or heterocoagulation, and coalescence and wherein the temperature of aggregation can be utilized to control the final toner particle size, that is average volume diameter; processes for the direct preparation of black and colored toner compositions with, for example, excellent colorant dispersions and narrow toner GSD and wherein a functionalized wax, such as waxes containing amines, and amides for example Aqua Superslip 6550, Superslip 6530, a polyethylene/amide available from Micro powder Inc, fluorinated waxes, for example Polyfluo 190, Polyflo 200, Polyfluo 523XF, Aqua Polyfluo 411, polyethylene/PTFE (polytetrafluoroehtylene) functionalized waxes, Aqua Polysilk 19, Polysilk 14, polethylene/PTFE/amide functionalized waxes available from Micro Powders Inc., mixed fluorinated amide waxes, for example Microspersion 19, available from Micro powder Inc, imides, esters, quaternary amines, carboxylic acids or acrylic polymer emulsions, available for example as Joncryl 74, 89, 130, from Johnson & Son, chlorinated polypropylenes, chlorinated polyethylenes, and the like; processes for black and colored toner compositions by (i) preparing, or providing a latex emulsion comprising polymeric particles which are preferably submicron in size, in an aqueous media containing anionic and nonionic surfactant, (ii) preparing, or providing a dispersion mixture of a functionalized wax and colorant, preferably containing submicron functionalized wax and submicron colorant particles, dispersed in a water containing a cationic surfactant; (iii) shearing the resulting wax/colorant dispersion with a latex emulsion thereby causing a flocculation of the latex particles with wax and colorant particles, which on further stirring enables the formation of electrostatically stable aggregates of from about 2 to about 20 microns in volume average diameter as measured by the Coulter Counter; (iv) optionally, but preferably adding additional, for example about 1 to about 10 weight percent of anionic or nonionic surfactant to the formed aggregates to, for example, to increase their stability and to substantially retain their particle size and particle size distribution during heating; and (v) coalescing and/or fusing the aggregated particle mixture by heat to toner composites, or a toner composition comprised of resin, colorant, functionalized wax, and wherein substantially no wax rejection results; processes comprised of (i) preparing a latex emulsion comprising resin particles which are in the size range of about 0.1 to about 0.3 microns in diameter, in an aqueous media containing anionic and nonionic surfactants; (ii) preparing a functionalized wax dispersion containing an ionic surfactant, and preferably a nonionic surfactant and colorant dispersion in a nonionic surfactant; (iii) preparing (includes also providing throughout), a coaugualant solution of a polyaluminium halide, especially chloride in an acid, such as a dilute acid, like dilute nitric acid, where the acid concentration is for example, about 3 to about 10 weight percent by weight of water; (iv) shearing the latex with the wax colorant dispersion, and coaugaulating with polyaluminium halide, thereby resulting in the flocculation of resin particles, colorant, and wax particles; (v) stirring and heating the resulting blend of (iv) to a temperature of about 2 to about 10 degrees Centigrade equal to, or below about the latex resin Tg to obtain toner size particles which are in the size range of about 2 to about 25, or more specifically about 4 to about 8 microns, with narrow particle size distribution; (vi) adjusting or increasing the pH of the aggregate blend (v) from a pH of about 3.0 to about 7.0 with a base, like sodium hydroxide at a concentration of about 0.5 to about 10 weight percent and preferably about 1.0 to about 8.0 weight percent, to for example provide for the stability of the aggregate particles during the coalescence; (vii) heating the aggregates at from about 15 to about 25 degrees Centigrade above the resin Tg to cause fusion, fusing, or coalescence of the aggregates and to form toner comprised of resin, colorant, and functionalized wax; processes for the preparation of toner comprising:

(i) preparing a latex emulsion comprised of submicron, for example about 0.05 to about 0.99 micron, resin particles in an ionic surfactant and a nonionic surfactant;

(ii) preparing a functionalized wax/colorant dispersion in water, which dispersion is comprised of submicron diameter, about 0.05 to about 0.99 microns, functionalized wax particles suspended in an aqueous phase containing an ionic surfactant and preferably a nonionic surfactant, a colorant dispersion containing, submicron colorant particles suspended in an aqueous phase containing a nonionic surfactant, to which a counterionic surfactant with a charge polarity of opposite sign to the ionic surfactant employed in the latex is added;

(iii) shearing the resulting functionalized wax/colorant dispersion with a latex comprised of resin, anionic surfactant, nonionic surfactant, and water, and wherein the latex solids content, which solids are comprised of resin, functionalized wax, and colorant, thereby causing a flocculation of functionalized wax, colorant, and resin particles in an aqueous, preferably water throughout, mixture containing anionic, nonionic and cationic surfactants;

(iv) heating the resulting sheared, flocculated blend at a temperature of from about 5 to about 25° C. below about the glass transition temperature (Tg) of the resin, while continuously stirring to form toner sized aggregates with a narrow size distribution; and (v) adding an anionic stabilizer to the electrostatically formed aggregated, and heating the aggregated particles at a temperature of from about 5 to about 50° C. and preferably from about 6 to about 25° C. or degrees centigrade above about the Tg of the resin, followed by cooling, to provide a toner composition comprised of resin, functionalized wax, colorant, and wherein the wax is from about 90 to about 100 incorporated in the toner; processes for the preparation of toner comprising:

(i) preparing (includes providing throughout) a latex emulsion of submicron resin particles in an anionic surfactant and a nonionic surfactant mixture;

(ii) preparing a functionalized wax dispersion in water, which dispersion is comprised of submicron wax particles suspended in an aqueous phase containing a an ionic surfactant and preferably a nonionic surfactant, a colorant dispersion containing submicron colorant particles suspended in an aqueous phase containing a nonionic surfactant;

(iii) preparing an acidic aqueous solution of a polyaluminium halides such as chloride coagulating medium wherein the amount of polyaluminium chloride is from about 1.5 to about 3.0 grams, with a solids content of about 10 weight percent by weight of water, and thereafter adding this solution to an acid, such as a dilute nitric acid solution, and which acid is selected in an amount of from about 3 to about 10 grams and the acid concentration is in the range of about 3 to about 10 weight percent of water;

(iv) shearing the resulting functionalized wax/colorant dispersion with a latex comprised of resin, anionic surfactant, nonionic surfactant, and water, and causing a flocculation of wax, colorant, and resin in an aqueous media containing anionic and nonionic surfactants, and polyaluminium chloride, or halide;

(v) heating the resulting sheared flocculated blend at a temperature of from about 2 to about 10° C. below the glass transition temperature (Tg) of the resin while continuously stirring to form toner sized aggregates with a narrow size distributions and;

(vi) adjusting the pH of the above aggregate blend, from a pH which is in the range of about 2.3 to 3.3, to a pH of about 6.5 to about 7.0, by the addition of base, such an alkai metal hydroxide, such as a sodium hydroxide solution, with a concentration in the range of about 0.5 to about 10 weight percent; and (vii) heating the aggregated particles at a temperature of from about 15 to about 35° C. above about the Tg of the resin, but below about 100 degrees Centigrade, to provide a toner composition comprised of resin, functionalized wax, and colorant, wherein the wax is substantially completely incorporated into the toner; a process comprised of dispersing a colorant and optionally toner additives like a charge control agent or additive in an aqueous mixture containing an cationic surfactant in amount of from about 0.5 percent (weight percent throughout unless otherwise indicated) to about 10 percent; dispersing a functionalized wax in the aqueous mixture, or water mixture with nonionic or ionic surfactant in amount of from about 0.5 percent to about 10 percent and shearing the colorant and wax dispersions with a latex or resin generated by emulsion polymerization, and which resin is comprised of suspended submicron particles of from, for example, about 0.01 micron to about 1 microns in volume average diameter (throughout unless otherwise specifically indicated), in an aqueous solution containing a counterionic surfactant in amounts of from about 1 percent to about 10 percent with an opposite charge to the ionic surfactant of the colorant dispersion, and nonionic surfactant in amounts of from about 0 percent to about 5 percent, and causing a flocculation of resin particles, wax, colorant particles and optional charge control agent, followed by heating at about 5 to about 40° C. below the resin Tg and preferably about 5 to about 25° C. below the resin Tg while stirring to form statically bound aggregates of from about 1 micron to about 10 microns in volume average diameter comprised of resin, wax, and colorant, and thereafter adding an anionic stabilizer, followed by heating the formed bound aggregates above the Tg (glass transition temperature) of the resin, processes which comprises mixing a functionalized wax, in the size diameter range of about 0.1 to 0.4 microns, and stabilized by a nonionic surfactant, with a latex containing submicron resin particles in the size diameter range of about 0.1 to about 0.5 microns, and stabilized by an anionic surfactant and a nonionic surfactant, shearing the mixture utilizing a high shearing device such as a polytron, with a colorant dispersion, comprising submicron colorant particles in the size diameter range of about 0.08 to about 0.2 microns, and stabilized in a nonionic surfactant and a cationic surfactant mixture, thereby resulting in flocculation or hetrocoagulation of resin particles, wax and colorant particles; and which upon further heating and stirring results in the formation of statically bound aggregates ranging in size of about 1 to about 10 microns, where the size and the distribution of the aggregates can be controlled by the temperature, for example heating at about 5 to about 20 degrees Centigrade below the resin Tg; adding an anionic stabilizer, followed by heating at about 20 to about 50 degrees Centigrade above the resin Tg to provide sintering or coalescence of the resin, colorant, and wax particles.

In aspects thereof the present invention is directed to a process of preparing wax containing toner particles which comprises the mixing of a functionalized wax such as waxes containing functional groups attached, or covalently bonded to the wax polymer backbone, such functional groups including amines, amides, imides, esters, quaternary amines, carboxylic acids groups, and the like, and wherein the size of such functionalized wax for example, in the range of about 0.1 to about 0.4 micron in diameter, and preferably about 0.08 to about 0.3 microns, wherein the wax particles are stabilized by an ionic and preferably a nonionic surfactant, with a latex containing submicron suspended resin particles, such as poly (styrene butylacrylate acrylic acid), poly (styrene butadiene acrylic acid), poly (styrene butadiene acrylic acid), poly (styrene isoprene acrylic acid), poly (styrene butylacrylate isoprene acrylic acid), poly (styrene acrylonitrile acrylic acid), poly (styrene butylacrylate isoprene acrylotrile acrylic acid), in the size range of about 0.1 to about 0.5 microns, stabilized by an anionic surfactant such as Neogen R or Neogen RK and a nonionic surfactant such as Anthrox CA 897, shearing the mixture utilizing a high shearing device such as a polytron, with a colorant dispersion of submicron colorant particles in the size range of about 0.08 to about 0.2 microns, stabilized in a nonionic surfactant and a cationic surfactant, thereby resulting in flocculation or hetrocoagulation of resin particles, wax and colorant particles, and which upon further heating and stirring above the room temperature, but below the resin Tg, results in the formation of statically bound aggregates ranging in size of for example, about 1 to 10 microns and where the size and the distribution of the aggregates is controlled by the heating temperature; thereafter adding an anionic stabilizer, followed by heating about 20 to about 50 degrees Centigrade above the resin Tg for a period of about 1 to about 6 hours, to provide fusion or coalescence of the resin, colorant and wax particles, and wherein the selection of the functionalized waxes, inclusive of chloropraffins, fluropraffins, and waxes containing amines, amides esters quaternary amines, and carboxylic acids permit the wax to remain with the resin and colorant particles during the coalescence thereby preventing or minimizing the migration of the wax into the aqueous phase, despite the wax being mobile at the coalescence temperature; a process for the preparation of toner comprising:

(i) preparing, or providing a colorant dispersion;

(ii) preparing, or providing a wax dispersion comprised of a functionalized wax, contained in a dispersant mixture comprised of a nonionic surfactant, an ionic surfactant, or mixtures thereof;

(iii) shearing the resulting mixture of the wax dispersion (ii) and the colorant dispersion (i) with a latex or emulsion blend comprised of resin particles suspended in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin particles; and optionally (vii) separating the toner particles; a toner process wherein the functionalized wax is selected from the group consisting of polyethylene/amide, polyethylene/polytetrafluoroethylene, polethylene/polyethylenetetrafluoroethylene/amide, and mixtures thereof, and wherein there is added additional anionic surfactant in (v), and separating the toner after cooling; a process for the preparation of toner compositions comprising:

(i) preparing, or providing an aqueous colorant dispersion containing colorant particles stabilized by a nonionic surfactant and water;

(ii) preparing, or providing a functionalized wax dispersion containing wax particles stabilized by a nonionic surfactant, an anionic surfactant, or mixtures thereof;

(iii) shearing the wax, colorant, and a latex mixture containing a resin, with a poly aluminum halide solution, resulting in a flocculation of the said wax, colorant, and latex particles;

(iv) heating the resulting sheared blend equal to or below the glass transition temperature (Tg) of the resin latex, to form electrostatically bound toner size aggregates and (v) adjusting the pH of the toner aggregates (v) to from about 2 to about 7.5 with a base; and (vi) heating the resulting blend to about 10 to about 30 degrees Centigrade above the latex resin Tg, and optionally (vii) separating the toner particles from the resulting aqueous slurry and optionally washing; a process for the preparation of toner compositions comprising:

(i) providing, or preparing a latex emulsion comprised of submicron resin particles which are in the size range of between about 0.1 to about 0.4 microns in volume average diameter, in an ionic surfactant and a nonionic surfactant:

(ii) preparing a functionalized wax/pigment dispersion in water, which dispersion is comprised of submicron wax particles which are in the size range of between about 0.1 to about 0.3 microns in volume average diameter, suspended in an aqueous phase containing an ionic surfactant and a nonionic surfactant, a pigment dispersion containing submicron pigment particles suspended in an aqueous phase containing a nonionic surfactant, to which a counterionic surfactant with a charge polarity of opposite sign to the ionic surfactant of employed in the latex is added;

(iii) shearing the wax/pigment dispersion with a latex comprised of resin, anionic surfactant, nonionic surfactant, and water, and wherein the latex solids content, which solids are comprised of resin, is from about 50 weight percent to about 20 weight percent and the solids of the wax is from about 20 to about 50 weight percent, and the solids content of the pigment is about 20 to about 55 eight percent thereby causing a flocculation of wax, pigment, and resin particles in an aqueous media containing anionic, nonionic and cationic surfactants.

(iv) heating the above sheared, flocculated blend at a temperature of from about 5 to about 25° C. below about the glass transition temperature (Tg) of the resin to form toner aggregates and;

(v) adding an anionic stabilizer to the electrostatically formed aggregates, and heating at a temperature of from about 5 to about 50° C. above about the Tg of the resin to provide a toner composition comprised of resin, wax, and pigment, and wherein the wax is completely incorporated, optionally about from about 95 to about 100 percent, in the toner; a process wherein said submicron pigment particles are in the size range of between about 0.08 to about 0.3 microns in volume average diameter and are suspended in an aqueous phase containing a nonionic surfactant, and wherein there is further prepared an acidic aqueous solution of a poly aluminum chloride as a coagulating medium, wherein the amount of poly aluminum is from about 1.0 to 3.0 grams, and which is added to an acid solution in the range from about 3.0 to about 10 grams; and shearing the wax/pigment dispersion with a latex comprised of resin, anionic surfactant, nonionic surfactant, and water; and wherein the latex solids are comprised of resin, functionalized wax pigment is thereby causing a flocculation of wax, pigment, resin particles in an aqueous media containing anionic, nonionic surfactants and poly aluminum chloride; heating the resulting sheared, flocculated blend at a temperature of from about 1 to about 10° C. below the glass transition temperature (Tg) of the resin to form toner sized aggregates and; adjusting the pH of the aggregate blend from a pH which is in the range of about 2.3 to 3.3 to a pH of about 6.3 to about 7.0 with the addition of a base; and heating the aggregated particles at a temperature of from about 15 to about 25° C. above about the Tg of the resin to provide a toner composition comprised of resin, functionalized wax, and pigment wherein the wax is totally, from about 95 to about 100 percent, incorporated in the toner particles resulting, and (v) cooling, and isolating the toner product; and a toner process which comprises the shearing of a (i) a colorant dispersion; and a (ii) a wax dispersion containing wax, in a dispersant comprised of a nonionic surfactant, an ionic surfactant or mixtures thereof; with (iii) a latex or emulsion blend comprised of resin suspended in a mixture of anionic surfactant and a nonionic surfactant;

(iv) heating the resulting sheared blend of (iii) below about the glass transition temperature (Tg) of the resin; and (v) adding additional anionic surfactant to the resulting aggregated suspension of (iv);

(vi) heating the resulting mixture of (v) above about the Tg of the resin and (vii) isolating the toner.

Also, more specifically the present invention is directed to in situ process comprised of first dispersing a pigment, such as HELIOGEN BLUE™ or HOSTAPERM PINK™, in an aqueous mixture containing a cationic surfactant such as benzalkonium chloride (SANIZOL B-50™), utilizing a high shearing device, such as a Brinkmann Polytron, microfluidizer or sonicator, dispersing a functionalized wax in the aqueous mixture, or water mixture containing a nonionic or ionic surfactant, by adding the wax, which is heated above its melting point, to water containing a nonionic or ionic dispersant or surfactant while simultaneously subjecting the mixture to a high shearing device such as a Brinkmann Polytron, microfluidizer or sonicator; subsequently shearing the pigment and wax dispersions with a latex of suspended resin, or polymer particles, such as poly(styrene butadiene acrylic acid), poly(styrene butylacrylate acrylic acid) or PLIOTONE™ a poly(styrene butadiene), and which particles are, for example, of a size ranging from about 0.01 to about 0.5 micron in volume average diameter as measured by for example, the Brookhaven nanosizer, in an aqueous surfactant mixture containing an anionic surfactant, such as sodium dodecylbenzene sulfonate (for example NEOGEN R™ or NEOGEN SC™) and a nonionic surfactant, such as alkyl phenoxy poly(ethylenoxy)ethanol (for example IGEPAL 897™ or ANTAROX 897™), thereby resulting in a flocculation, or heterocoagulation of the resin particles with the wax and pigment particles, and which, on further stirring for example, from about 1 to about 3 hours while heating, for example, from about 35 to about 45° C., results in the formation of statically bound aggregates ranging in size of from about 0.5 micron to about 10 microns in volume average diameter as measured by the Coulter Counter (Microsizer II), where the size of the aggregated particles and their distribution can be controlled by the temperature of heating, for example from about 5 to about 25° C. below the resin Tg, and where the speed at which toner size aggregates are formed can also be controlled by the temperature; heating from about 5 to about 50° C. above the resin Tg to provide for particle fusion and/or coalescence of the polymer, wax and pigment particles, cooling, isolating the toner, and followed by washing with, for example, hot water, about 45 to about 65 degrees Centigrade to remove surfactant, and drying whereby toner particles comprised of resin, wax and pigment with various particle size diameters can be obtained, such as from about 1 to about 20, and preferably from about 3 to about 10 microns in volume average diameter; processes comprising generating both a pigment dispersion and separately an aqueous dispersion of submicron stabilized functionalized wax particles in a nonionic and a cationic surfactant, and wherein the cationic pigment dispersion is generated, for example by dispersing an aqueous mixture of a pigment or pigments, such as carbon black like REGAL 330®, phthalocyanine, quinacridone or RHODAMINE B™ type with a cationic surfactant, such as benzalkonium chloride, with a suspended resin mixture comprised of polymer components such as poly (styrene butadiene) or poly(styrene butylacrylate), and wherein the particle size of the suspended resin mixture is, for example, from about 0.01 to about 0.5 microns, in an aqueous surfactant mixture containing an anionic surfactant such as sodium dodecylbenzene sulfonate and nonionic surfactant, resulting in a flocculation, or heterocoagulation of the polymer or resin particles with the pigment particles, and further stirring the mixture using a mechanical stirrer at about 250 to about 500 rpm while heating below about the resin Tg, for example from about 5 to about 15° C., and allowing the formation of electrostatically stabilized aggregates ranging in size of from about 0.5 micron to about 10 microns, followed by the addition of an anionic stabilizer in the range amount of about 0.1 to about 10 weight percent by weight of water; heating above about the resin Tg, for example from about 5 to about 50° C., to cause coalescence of the latex, pigment and wax particles with full incorporation of the wax, cooling, isolating the toner product, and then washing with, for example, hot water to remove, for example, surfactant, and drying such as by use of an Aeromatic fluid bed dryer, freeze dryer, or spray dryer, whereby toner particles with various particle size diameters can be obtained, such as from about 1 to about 10 microns in volume average particle diameter as measured by the Coulter Counter; processes for the preparation of toner compositions which comprises initially generating both a pigment dispersion and wax dispersion of submicron stabilized functionalized wax particles in an ionic or a nonionic surfactant, and wherein the pigment dispersion contains for example, carbon black like REGAL 330®, phthalocyanine, quinacridone or RHODAMINE B™ type in a nonionic surfactant, and mixing with a suspended resin mixture comprised of polymer components such as poly(styrene butadiene) or poly(styrene butylacrylate), and wherein the particle size of the suspended resin mixture is, for example, from about 0.01 to about 0.5 micron in an aqueous surfactant mixture containing an anionic surfactant, such as sodium dodecylbenzene sulfonate and nonionic surfactant, to which a polyaluminium halide, such as chloride in an acid, such as a dilute nitric acid solution is added, resulting in a flocculation, or heterocoagulation of the polymer or resin particles, pigment, and wax particles, and further stirring the mixture using a mechanical stirrer at about 250 to 500 rpm while heating equal to or below the resin Tg, for example from about 2 to about 10° C., and allowing the formation of electrostatically stabilized aggregates ranging from about 3 micron to about 10 microns; adjusting or increasing the pH of the aggregate blend, from a pH of about 3.0, to about 6.5, followed by heating above about the resin Tg, for example from about 12 to about 50° C. and preferably from about 15 to 25 degrees Centigrade, to cause coalescence of the latex, pigment and wax particles with full incorporation of the wax in the absence of any additional stabilizer, isolating, and by washing with, for example, hot water to remove, for example, surfactants, and drying such as by the use of an Aeromatic fluid bed dryer, freeze dryer, or spray dryer; whereby toner particles comprised of resin pigment, and optional charge control additive with various particle size diameters can be obtained, such as from about 3 to about 20 microns in average volume particle diameter as measured by the Coulter Counter; and processes which comprise (i) preparing an ionic pigment mixture by dispersing a pigment such as carbon black like REGAL 330®, HOSTAPERM PINK™, or PV FAST BLUE™ of from about 2 to about 10 percent by weight of toner in an aqueous mixture containing a cationic surfactant such as dialkylbenzene dialkylammonium chloride like SANIZOL B-50™ available from Kao, or MIRAPOL™ available from Alkaril Chemicals, and from about 0.5 to about 2 percent by weight of water, utilizing a high shearing device such as a Brinkmann Polytron or IKA homogenizer at a speed of from about 3,000 revolutions per minute to about 10,000 revolutions per minute for a duration of from about 1 minute to about 120 minutes; (ii) adding an aqueous dispersion of a functionalized wax; (iii) adding the aforementioned ionic pigment mixture together with the wax dispersion in a quantity such that the wax component contributes between about 1 to about 20 percent and preferably about 2 to about 10 percent of the final mass of the toner, to an aqueous suspension of resin particles comprised of, for example, poly(styrene-butylmethacrylate), PLIOTONE™ or poly(styrene-butadiene) and which resin particles are present in various effective amounts, such as from about 40 percent to about 98 percent by weight of the toner, and wherein the polymer resin latex particle size is from about 0.1 micron to about 3 microns in volume average diameter, and counterionic surfactant such as an anionic surfactant like sodium dodecylsulfate, dodecylbenzene sulfonate or NEOGEN R™ from about 0.5 to about 2 percent by weight of water, a nonionic surfactant such polyethylene glycol or polyoxyethylene glycol nonyl phenyl ether or IGEPAL 897™ obtained from GAF Chemical Company, from about 0.5 to about 3 percent by weight of water, thereby causing a flocculation of pigment, wax and resin particles with the use of a high shear homogenizer; (iv) and further stirring with a mechanical stirrer from about 250 to 500 rpm about below the resin Tg at, for example, about 5 to 15° C. below the resin Tg at temperatures of about 35 to 50° C. to form electrostatically stable aggregates of from about 0.5 micron to about 5 microns in average volume diameter; (v) adding additional anionic surfactant or nonionic surfactant in the amount of from 0.5 percent to 10 percent by weight of water to stabilize the aggregates formed; heating the statically bound aggregate composite particles at from about 60° C. to about 100° C. for a duration of for example, about 60 minutes to about 600 minutes to form toner sized particles of from about 1 to about 25, and more specifically from about 3 microns to about 7 microns in volume average diameter and with a geometric size distribution of from about 1.2 to about 1.3 as measured by the Coulter Counter; and (vi) isolating the toner sized particles, washing, filtering and drying thereby providing composite toner particles comprised of resin and pigment. Flow additives to improve flow characteristics, such additives including AEROSILS® or silicas, metal oxides like tin, titanium and the like, metal salts of fatty acids, like zinc stearate, and which additives are each present in various effective amounts, such as from about 0.1 to about 10 percent by weight of the toner can then be added to the toner product.

Examples of the functionalized waxes are as illustrated herein, and include for example Joncryl 74, 89, 130, 537, and 538 all available from SC Johnson Wax, chlorinated polypropylenes and polyethylenes commercially available from Allied Chemical and Petrolite Corporation and SC Johnson wax; hydrocarbon waxes with for example from about 8 to about 40, and preferably from about 8 to about 40 carbon atoms and which waxes contain functionalized end groups, such as maleic anhydride, polyimides, polyamines, poly quatuanary amines, polyacids, polyesters, polyester acids, and the like, and having a molecular weights, Mw in the range of about 2,000 to about 10,000; functionalized UNILIN $^{R}$ Alcohols, such as UNILIN 350, 425, 550, UNITHOX $^{R}$, Ethyloxylated alcohols such as UNITHOX 420, 450, 480, 520, UNICID $^{R}$ Carboxylic acid such as UNICID 350, 425, 550, VYBAR $^{R}$ hydrocarbons such as VYBAR 103, 253, 260, maleic functional polymers such as CERAMER R 67, 5005, 5075 containing half esters of maleic anhydride on the polymer backbone, and copolymers of Alpha olefin/maleic anhydride such as X-8043, X-8044, Q-0048, X-8040 all having high acid numbers, and wherein the acid number is for example in the range of 150 to about 400, and the like. Generally when heating toner aggregates containing non functionalized waxes, such as Polyethylene 100P wax, above the resin Tg for example in the temperature range of about 90 to 105 degrees Centigrade and where at the wax is mobile, there usually results considerable wax rejection, for example from 25 to 60 percent. The use of waxes with functional groups, such as amines, amides, imides, esters, quaternary amines, alcohols, carboxylic acids, hydrocarbons, and the like, have less affanity for water and greater affinity for the latex resin and will not substantially migrate, or escape into the aqueous phase during coalescence.

Illustrative examples of specific resin particles, resins or polymers selected for the process of the present invention and present in the latex, and in the final toner include known polymers such as poly(styrene-butadiene), poly(para-methyl styrene-butadiene), poly(meta-methyl styrene-butadiene), poly(alpha-methyl styrene-butadiene), poly (methylmethacrylate-butadiene), poly(ethylmethacrylate-butadiene), poly(propylmethacrylate-butadiene), poly (butylmethacrylate-butadiene), poly(methylacrylate-butadiene), poly(ethylacrylate-butadiene), poly (propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene); polymers such as poly (styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™ (Reichhold Chemical Inc), PLASTHALL™ (Rohm & Hass), CYGAL™ (American Cyanamide), ARMCO™ (Armco Composites), CELANEX™ (Celanese Eng), RYNITE™ (DuPont), STYPOL™, and the like. The resin selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly (styrene butylacrylate acrylic acid) or poly(styrene butadiene acrylic acid).

The resin selected for the process of the present invention is preferably prepared from emulsion polymerization methods, and the monomers utilized in such processes include styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups on the polymer is optional, however when present such groups can be present in various amounts of from about 0.1 to about 10 percent by weight of the polymer resin. Known chain transfer agents, for example dodecanethiol, about 1 to about 10 percent, water soluble thiols such as butanethiol, propanethiol or carbon tetrabromide in effective amounts, such as from about 1 to about 10 percent, can also be selected when preparing the resin particles by emulsion polymerization.

Various known colorants present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB560™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. The colorants selected are present in various effective amounts, such as from about 1 weight percent to about 65 weight and preferably from about 2 to about 12 percent of the toner.

Colorant includes pigment, dye, mixtures of pigments and dyes, mixtures of dyes, mixtures of pigments, and the like.

Examples of second waxes, that is non functionalized haxes include those as illustrated herein such as polypropylenes and polyethylenes commercially available from Allied Chemical and Petrolite Corporation, wax emulsions available from Michaelman Inc. and the Daniels Products Company, Epolene N-15 commercially available from Eastman Chemical Products, Inc., Viscol 550-P, a low from about 1,000 to about 20,000 (Mw) weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 6,000. Many of the polyethylene and polypropylene compositions useful in the present invention are illustrated in British Patent No. 1,442,835, the disclosure of which is totally incorporated herein by reference.

The second low molecular weight wax materials are present in the toner composition of the present invention in various amounts; generally these waxes are present in the toner composition in an amount of from about 1 percent by weight to about 15 percent by weight, and preferably in an amount of from about 1 percent by weight to about 5 percent by weight. The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, E84, E88, Bromat S1, and the like.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Cationic surfactant examples, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2. β6608 Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size, or minimize the growth of the particles, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregated comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include titanium dioxide, titanotics, such as stronium totanite, zinc stearate silicas, and coated silicas, such as AEROSIL R972® available from Degussa, each in amounts of from about 0.1 to about 2 percent can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. Nos. 4,265,660, 4,585,884, 4,563,408, and 4,584,253 the disclosures of which are totally incorporated herein by reference.

The following Examples are being submitted to further define various species of the present invention. These Examples are intended to be illustrative only and are not intended to limit the scope of the present invention. Also, parts and percentages are by weight unless otherwise indicated. For the functionalized wax toners the product toner particle size was similar to the aggregated size.

Latex Preparation

A latex was prepared by the emulsion polymerization of a composition of styrene:butylacrylate and acrylic acid in the ration of 82:18 with 2 pph acrylic acid) in a mixture of a nonionic surfactant and an anionic surfactant in water as follows. 1,408 Grams of styrene, 192 grams of butyl acrylate, 32 grams of acrylic acid, and 48 grams of dodecanethiol were mixed with 2,400 milliliters of deionized water in which 36 grams of sodium dodecyl benzene sulfonate anionic surfactant (NEOGEN R™ which contains 60 percent of active component), 34.4 grams of polyoxyethylene nonyl phenyl ether—nonionic surfactant (ANTAROX 897™—70 percent active), and 16 grams of ammonium persulfate initiator were dissolved and stirred at room temperature, about 25 degrees Centigrade throughout, for a period of 30 minutes. The emulsion was then polymerized at 70° C. for 6 hours. The resulting latex was comprised of 60 percent water and 40 percent (weight percent throughout) solids comprised of a copolymer of polystyrene/polybutyl acrylate/polyacrylic acid, 82/18/2 pph; the Tg of the latex dry sample was 53.1° C., as measured on a DuPont DSC; $M_w$=26,600, and $M_n$=9,000 as determined on Hewlett Packard GPC. The particle size of the latex as measured on Brookhaven BI-90 Particle Nanosizer was 160 nanometers. The aforementioned latex was then selected for the toner preparation in all the following examples:

EXAMPLE I

Toner preparation

To 260 grams of the above latex containing 40 weight percent of solids by weight of water was added in a reactor a pigment solution comprising 7.6 grams of a Blue 15.3 pigment dispersion having a solids content of 53.4 weight percent in water, 150 grams of water and 1.5 grams of the cationic surfactant (Sanizol B) and 30 grams of a functionalized wax of the fluorinated paraffin wax dispersion (LX 1118) obtained from Baker Petrolite, and having a solids content of 40 weight percent in the water/noninic surfactant solution, 100 grams of water and 0.7 grams of a cationic surfactant (Sanizol B) and ploytroned in 350 grams of water at a speed of 5000 RPM using an IKA homogenizer. The resulting blend was then transferred into a reaction kettle. The contents the kettle was stirred and the temperature was raised to 50 degrees Centigrade resulting in a aggregates of 6.2 microns (volume average throughout) and a GSD of 1.20. After a period of 2 hours, 50 milliliters of 20 weight percent by weight of water was added to stabilize the aggregates, after which the temperature was raised to 83 degrees Centigrade and held there for a period of 4 hours. The resulting particles as measured on the Coulter Counter showed a size of 6.4 microns with a GSD of 1.21. The reactor contents were then cooled down and upon filteration showed a clear filterate indicating that the wax was incorporated, about 95 to about 100 percent, into the host resin of the latex. The toner was washed twice with potassium hydroxide at a pH of 11 followed by two more washings with deionized water. The particles were then freeze dried and sent for tribo evaluation, and which evaluation utilizing the Faraday Cage indicated a toner tribo value of −33 uC/g. The same cyan toner with no wax had a tribo of −26 uc/g.

The fusing behavior of this functionalized wax toner was evaluated using a bench fusing fixture based on the fusing subassembly removed from a Xerox 5765 copier/printer modified in such a way as to allow for the control and measurement of the temperature of the heated fusing roll. The unit was operated without the use of any oiling system to evaluate the release behavior of the toner layer from the hot fuser roll. With this toner there was no visible sign of adhesion between the hot toner layer and the fuser roll, or toner stripping, over the range of temperatures between 130 and 200 degrees Centigrade.

EXAMPLE II

Toner preparation

To 260 grams of the above latex containing 40 weight percent of solids by weight of water was added a pigment solution comprising of 7.6 grams of a Blue 15.3 pigment dispersion having a solids content of 53.4 weight percent in water, 150 grams of water and 1.5 grams of cationic surfactant (Sanizol B) and 30 grams of the polypropylene functionalized wax with an ester-maleic anhydride wax dispersion (LX 1306) obtained from Baker Petrolite, and with a solids content of 40 weight percent in the water/noninic surfactant solution, 100 grams of water and 0.7 grams of a cationic surfactant (Sanizol B), and ploytroned in 350 grams in water at a speed of 5,000 RPM using an IKA homogenizer.

The resulting blend was then transferred into a reaction kettle. The contents the kettle was stirred and the temperature was raised to 50 degrees C. (Centigrade throughout) resulting in a aggregates of 6.0 microns and a GSD of 1.21. After a period of 2.2 hours, 50 milliliters of 20 weight percent by weight of water was added to stabilize the aggregates, after which the temperature was raised to 83 degrees Centigrade and held there for a period of 4 hours. The resulting aggregated particles measured on the Coulter Counter showed a size of 6.3 microns with a GSD of 1.21. The contents were then cooled down to about 25 degrees Centigrade, and upon filteration showed a clear filterate indicating that the wax was incorporated, about 97 percent into the host resin of the latex. The toner was washed twice with potassium hydroxide at a pH of 11 followed by two further washings with deionized water. The particles were then freeze dried and sent for tribo evaluation, resulting in a tribo value of −29 uC/g, as opposed to the same cyan toner containing no wax, whose tribo was −26 uc/g.

The release behavior of the above functionalized wax toner was evaluated in the same manner as described in Example I above and there was no visible sign of adhesion between the hot toner layer and the fuser roll over the range of temperatures between 130 and 200 degrees Celsius.

EXAMPLE III

Toner preparation

To 260 grams of the above latex containing 40 weight percent of solids by weight of water was added a pigment solution comprising 7.6 grams of Blue 15.3 pigment dispersion having a solids content of 53.4 weight percent in water, 150 grams of water and 1.5 grams of cationic surfactant Sanizol maleic anhydride wax dispersion (LX 1306) obtained from Baker Petrolite having a solids content of 30 weight percent in a water/noninic surfactant solution, 100 grams of water and 0.7 grams of a cationic surfactant (Sanizol B) and ploytroned in 350 grams of water at a speed of 5,000 RPM using an IKA homogenizer. The resulting blend was then transferred into a reaction kettle. The contents of the kettle were stirred and the temperature was raised to 50 degrees Centigrade resulting in aggregates of 6.5 microns and a GSD of 1.21. After a period of 2.5 hours 50 milliliters of 20 weight percent by weight of water was added to stabilize the aggregates, after which the temperature was increased to 80 degrees Centigrade and held there for a period of 4 hours. The resulting particles as measured on the Coulter Counter showed a size of 6.8 microns with a GSD of 1.23. The reactor contents were then cooled down to 25 degrees Centigrade and upon filteration showed a clear filterate indicating that the wax was incorporated, about 95 to about 100 percent, into the host resin of the latex. The toner was washed twice with potassium hydroxide at a pH of 11 followed by two more washings with deionized water. The particles were then freeze dried and sent for tribo evaluation resulting in a tribo value of −35 uC/g as compared to the same cyan toner containing no wax whose tribo was −26 uc/g.

The release behavior of the above functionalized wax toner was evaluated in the same manner as described in Example I above and there was no visible sign of the adhesion between the hot toner layer and the fuser roll over the range of temperatures between 130 and 200 degrees Celsius.

EXAMPLE IV

Toner preparation

To 260 grams of the above latex containing 40 weight percent of solids by weight of water was added a pigment solution comprising 7.6 grams of Blue 15.3 pigment dispersion having a solids content of 53.4 weight percent in water, 150 grams of water and 1.5 grams of cationic surfactant (Sanizol B) and 30 grams of a polyethyene/amide wax dispersion (Aqua Superslip 6650) obtained from Micro Powders Inc having a solids content of 30 weight percent in water/noninic surfactant solution, 100 grams of water and 0.7 grams of a cationic surfactant (Sanizol B) and ploytroned at a speed of 5000 RPM using an IKA homogenizer. The resulting blend was then transferred into a reaction kettle. The contents the kettle were stirred and the temperature was raised to 48 degrees C. resulting in a aggregates of 6.1 microns and a GSD of 1.22. After a period of 2.0 hours 60 milliliters of 20 weight percent by weight of water was added to stabilize the aggregates, after which the temperature was raised to 80 degrees Centigrade and held there for a period of 4 hours. The resulting particles (toner throughout the Examples) as measured on the coulter counter showed a size of 6.5 microns with a GSD of 1.23. The kettle contents were then cooled down to room temperature, about 25 degrees Centigrade, and upon filteration showed a clear filterate indicating that the wax was totally incorporated, about 100 percent, into the host resin of the latex. The toner was washed twice with potassium hydroxide at a pH of 11 followed by two washings with deionized water. The toner particles 6.5 microns were then freeze dried and sent for tribo evaluation resulting in a tribo value of −30 uC/g as compared to the same as cyan toner containing no wax whose tribo was −26 uc/g.

The release behavior of the above wax toner was evaluated in the same manner as described in Example I above and there was no visible sign of the adhesion between the hot toner layer and the fuser roll over the range of temperatures between 130 and 200 degrees Celsius.

EXAMPLE V

Toner preparation

To 260 grams of the above latex containing 40 weight percent of solids by weight of water was added a pigment solution comprising 7.6 grams of Blue 15.3 pigment dispersion having a solids content of 53.4 weight percent in water, 150 grams of water and 1.5 grams of cationic surfactant (Sanizol B) and 30 grams of the polyethyene/PTFE/amide wax dispersion (Polysilk 14) obtained from Micro Powder INC having a solids content of 30 weight percent in water/noninic surfactant solution, 100 grams of water and 0.7 grams of a cationic surfactant (Sanizol B) and ploytroned in 350 grams of water at a speed of 5,000 RPM using an IKA homogenizer. The resulting blend was then transferred into a reaction kettle. The contents of the kettle were stirred and the temperature was raised to 48 degrees Centigrade resulting in a aggregates of 6.4 microns (volume average throughout) and a GSD of 1.22. After a period of 2.3 hours 50 milliliters of 20 weight percent by weight of water was added to stabilize the aggregates after which the temperature was raised to 82 degrees and held there for a period of 3.5 hours The resulting toner particles as measured on the Coulter Counter showed a size of 6.3 microns with a GSD of 1.22. The contents were then cooled down and upon filteration showed a clear filterate indicating that the wax was incorporated, about 95 to about 100 percent, into the host resin of the latex. The toner was washed twice with potassium hydroxide at a pH of 11 followed by two time with deionized water. The particles were then freeze dried and sent for tribo evaluation resulting in a tribo value of −31 uc/g. as opposed to the cyan toner containing no wax whose tribo was −26 uc/g. The release behavior of the above invention wax toner was evaluated in the same manner as described in Example I above and there was no visible sign of adhesion between the hot toner layer and the fuser roll over the range of temperatures between about 130 and about 200 degrees Celsius.

EXAMPLE VI

Toner preparation

To 260 grams of the above latex containing 40 weight percent of solids by weight of water was added a pigment solution comprising of 7.6 grams of Blue 15.3 pigment dispersion having a solids content of 53.4 weight percent in water, 150 grams of water and 1.5 grams of cationic surfactant (Sanizol B) and 30 grams of a styrene acrylic wax dispersion (Johncryl 130) obtained from S.C. Johnson Wax having a solids content of 30 weight percent in the water/noninic surfactant solution, 100 grams of water and 0.7 grams of a cationic surfactant (Sanizol B) and ploytroned in 350 grams of water at a speed of 5,000 RPM using an IKA homogenizer. The resulting blend was then transferred into a reaction kettle. The contents of the kettle were stirred and the temperature was raised to 48 degrees Centigrade resulting in a aggregates of 6.2 microns and a GSD of 1.21 after a period of 2.3 hours. 50 milliliters of 20 weight percent by weight of water was added to stabilize the aggregates, after which the temperature was raised to 82 degrees Centigrade and held there for a period of 3.5 hours. The resulting particles as measured on the Coulter Counter showed a size of 6.3 microns with a GSD of 1.21. The kettle contents were then cooled down and upon filteration showed a clear filterate indicating that the wax was incorporated, about 95 to about 100 percent, into the host resin of the latex. The toner was washed twice with potassium hydroxide at a pH of 11 followed by washing two more times with deionized water. The particles were then freeze dried and sent for tribo evaluation resulting in a tribo value of −30 uC/g as compared to the cyan toner containing no wax whose tribo was −26 uc/g. The release behavior of the above prepared functionalized wax toner was evaluated in the same manner as described in Example I above and there was no visible sign of adhesion between the hot toner layer and the fuser roll over the range of temperatures between 130 and 200 degrees Celsius or Centigrade.

EXAMPLE VII

Toner preparation with Poly Aluminum Chloride (PAC)

To 260 grams of the above latex containing 40 weight percent of solids by weight of water was added a pigment solution comprising 7.6 grams of Blue 15.3 pigment dispersion having a solids content of 53.4 weight percent in water, 150 grams of water and 30 grams of a fluorinated paraffin functionalized wax obtained from Baker Petrolite with a solids content of 40 weight percent in a water/noninic surfactant solution, 550 grams of water, 2.3 grams of PAC having a concentration of 10 weight percent and polytroned in 350 grams of water at a speed of 5,000 RPM using an IKA homogenizer. The resulting blend was then transferred into a reaction kettle. The contents of the kettle was stirred and the temperature was raised to 54 degrees Centigrade resulting in a aggregates of 5.8 microns and a GSD of 1.20 after a period of 2.3 hours. The pH of the blend was then adjusted from 3.0 to 6.5 with an aqueous sodium hydroxide solution with about 4 weight percent of water, after which the temperature was raised to 82 degrees and held there for a period of 3.5 hours. The resulting particles as measured on the coulter counter showed a size of 6.0 microns with a GSD of 1.21. The kettle contents were then cooled down and upon filteration showed a clear filterate indicating that the wax was incorporated, about 100 percent, into the host resin of the latex. The toner was washed twice with potassium hydroxide at a pH of 11 followed by two more washings with deionized water. The particles were then freeze dried and sent for tribo evaluation resulting in a tribo value of −30 uc/g (microcolumbs per gram throughout), as compared to the cyan toner containing no wax whose tribo was −26 uc/g. The release behavior of the above prepared functional wax toner was evaluated in the same manner as described in Example I above and there was no visible sign of adhesion between the hot toner layer and the fuser roll over the range of temperatures between 130 and 200 degrees Celsius.

COMPARATIVE EXAMPLE I

Toner preparation (No wax)

To 260 grams of the above latex containing 40 weight percent of solids by weight of water was added a pigment solution comprising 7.6 grams of cyan dispersion having a solids content of 53.4 weight percent in water, 200 grams of water and 2.3 grams of cationic surfactant (Sanizol B) and ploytroned in 400 grams of water at a speed of 5,000 RPM using an IKA homogenizer. The resulting blend was then transferred into a reaction kettle. The contents of the kettle were stirred and the temperature was raised to 48 degrees Centigrade resulting in a aggregates of 6.2 microns and a GSD of 1.21. After a period of 2.3 hours 50 milliliters of 20 weight percent by weight of water was added to stabilize the aggregates, after which the temperature was raised to 83 degrees and held there for a period of 3.5 hours. The resulting particles as measured on the Coulter Counter showed a size of 6.5 microns with a GSD of 1.21. The toner was washed twice with potassium hydroxide at a pH of 11 followed by two washings with deionized water. The particles were then freeze dried, and the toner tribo thereof (determined by the known Faraday Cage method throughout) was 26 uc/g. The release behavior of the above prepared toner from a hot fuser roll was evaluated in the same manner as described in Example I above and the hot toner layer was found to show severe interactions and stripping failure when the fuser roll was maintained at temperature above 160 degrees Centigrade.

COMPARATIVE EXAMPLE II

Toner preparation (Non functionalized wax)

To 260 grams of the above latex containing 40 weight percent of solids by weight of water was added a pigment solution comprising of 7.6 grams of Blue 15.3 pigment dispersion having a solids content of 53.4 weight percent in water, 150 grams of water and 1.5 grams of cationic surfactant (Sanizol B) and 40 grams of the nonfunctionalized polypropylene wax dispersion (P1,000) obtained from Baker Petrolite having a solids content of 30 weight percent in water/noninic surfactant solution, 100 grams of water and 0.7 grams of a cationic surfactant (Sanizol B) and ploytroned in 350 grams of water at a speed of 5,000 RPM using an IKA homogenizer. The resulting blend was then transferred into a reaction kettle. The contents the kettle were stirred and the temperature was raised to 48 degrees C. resulting in a aggregates of 6.2 microns and a GSD of 1.21. After a period of 2.3 hours 50 milliliters of 20 weight percent by weight of water was added to stabilize the aggregates, after which the temperature was raised to 82 degrees and held there for a period of 3.5 hours. The resulting particles as measured on the Coulter Counter showed a size of 6.3 microns with a GSD of 1.21. The kettle contents were then cooled down to room temperature, and showed wax rejection and upon filteration showed a white particle in the filterate. The toner was then washed twice with potassium hydroxide at a pH of 11 followed by two washings with deionized water. The particles were then freeze dried and sent for tribo evaluation resulting in a tribo value of −30 uc/g. as opposed to a cyan toner containing no wax whose tribo was −26 uc/g. The release behavior of the above prepared nonfunctionalized wax toner from a hot fuser roll was evaluated in the same manner as described in Example I above and the hot toner layer was found to show severe interactions and stripping failure when the fuser roll was maintained at any temperature above 170 degrees Centigrade.

COMPARATIVE EXAMPLE III

Toner preparation (Non functionalized wax)

To 260 grams of the above latex containing 40 weight percent of solids by weight of water was added a pigment solution comprising of 32 grams of Black pigment (Regal 330) dispersion having a solids content of 21 weight percent in water containing a nonionic surfactant, 150 grams of water and 1.5 grams of cationic surfactant (Sanizol B) and 40 grams of the nonfunctionalized wax, polyethylene wax dispersion (P725) obtained from Baker Petrolite having a solids content of 30 weight percent in water/noninic surfactant solution, 100 grams of water and 0.7 grams of a cationic surfactant (Sanizol B) and ploytroned in 350 grams of water at a speed of 5,000 RPM using an IKA homogenizer. The resulting blend was then transferred into a reaction kettle. The contents of the kettle were stirred and the temperature was raised to 48 degrees C. resulting in a aggregates of 6.5 microns and a GSD of 1.21 after a period of 2.3 hours 50 milliliters of 20 weight percent by weight of water was added to stabilize the aggregates, after which the temperature was raised to 80 degrees and held there for a period of 4 hours The resulting particles as measured on the coulter counter showed a size of 6.7 microns with a GSD of 1.22. The contents were then cooled down and the toner showed wax rejection and upon filteration showed a white particle in he filterate. The toner was washed twice with potassium hydroxide at a pH of 11 followed by two time with deionized water. The particles were then freeze dried and sent for tribo evaluation resulting in a tribo value of −24 uC/g. as compared to the same cyan toner containing no wax whose tribo was −20 uc/g. The release behavior of the above prepared wax toner from a hot fuser roll was evaluated in the same manner as described in Example I above and the hot toner layer was found to show severe interactions such as toner image stuck onto the fuser roll and stripping failure, that is the image and the paper remain wrapped around the fuser roll when the fuser roll was maintained at temperatures above 170 degrees Centigrade.

Functionalized waxes refer to for example, modified polyethylenes, or polypropylenes or hydrocarbons, each containing functional groups such as halide, preferably fluorine, amide imides, esters, quaternary amines, carboxylic acids, and mixtures thereof, on the polymer backbone and which waxes in a toner evidence less affanity towards water and greater affinity to the latex resin particles and they do not migrate, possess minimal migration, or do they escape into the aqueous phase during the toner coalescence.

Nonfunctionalized waxes refers for example, to polyethylenes, polypropylene, and hydrocarbons which have no functionalized groups attached on the backbone chain and which waxes show an affinity towards water and usually result in only about 20 to 40 wax weight percent incorporation into the toner particles, and result in the release and stripping problems indicated herein.

Other modifications of the present invention may occur to those skilled in the art subsequent to a review of the present application. The aforementioned modifications, including equivalents thereof, are intended to be included within the scope of the present invention.

What is claimed is:

1. A process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally (vii) separating the toner particles.

2. A process in accordance with claim 1 the functionalized wax is selected from the group consisting of polyethylene/amide, polyethylene/polytetrafluoroethylene, polethylene/polyethylenetetrafluoroethylene/amide, and mixtures thereof, and wherein there is added additional anionic surfactant in (v), and there is accomplished cooling, and separating the toner after cooling.

3. A process in claim 1 wherein heating the resulting mixture of (vi) above about the Tg of the resin particles is accomplished until coalescence and fusion results, and which heating temperature is in the range of about 10 to about 50 degrees Centigrade above the Tg of the resin particles.

4. A process in accordance with claim 3 wherein the heating in (vi) is at a temperature of about 15 to about 35 degrees Centigrade above the Tg of the resin and wherein said heating causes coalescence and fusing of the aggregates of (v).

5. A process for the preparation of toner comprising (i) preparing, or providing an aqueous colorant dispersion containing colorant particles stabilized by a nonionic surfactant and water;

(ii) preparing, or providing a functionalized wax dispersion containing functionalized wax particles stabilized by a nonionic surfactant, an anionic surfactant, or mixtures thereof;

(iii) shearing the wax, colorant, and a latex mixture containing a resin, with a poly aluminum halide solution, resulting in a flocculation of the said wax, colorant, and latex particles;

(iv) heating the resulting sheared blend equal to or below about the glass transition temperature (Tg) of the resin latex, to form electrostatically bound toner size aggregates and (v) optionally adjusting the pH of the toner aggregates (v) to from about 2.3 to about 6.5 with a base; and (vi) heating the resulting blend about above the latex resin Tg, and optionally (vii) separating the toner from the resulting aqueous slurry and optionally washing.

6. A process in accordance with claim 5 the functionalized wax is selected from the group consisting of polyethylene/amide, polyethylene/polytetrafluoroethylenepolethylene/polyethylenetetrafluoroethylene/amide, and mixtures thereof, and wherein the toner is isolated and washed.

7. A process in accordance with claim 5 the temperature of the aggregation (iv) is about 2 to 10 degrees below the resin Tg, for an optional period of about 1 to about 4 hours.

8. A process in accordance with claim 5 wherein the temperature of (vi) is about 1 to 30 degrees above the resin Tg for a period of about 1 to about 6 hours, and whereby coalescening and fusing of toner aggregates results.

9. A process in accordance with claim 1 wherein wax rejection into said resin is minimized by said functionalized wax, the heating in (vi) is at a temperature of from about 60 to about 90 degrees Centigrade thereby resulting in coalescence and fusing of the aggregates of (v).

10. A process in accordance with claim 5 wherein the halide for said poly aluminum halide is chloride and wherein said polyaluminum chloride is selected in an amount of about 0.1 to about 10 weight percent or from about 0.5 to 5 weight percent.

11. A process in accordance with claim 5 said solution (iii) contains an acid of nitric acid, hydrochloric acid, sulfuric acid, or acetic acid, and wherein the pH of the solution is in the range of about 2 to about 3.5, or in the range of from about 2.2 to about 3.3.

12. A process in accordance with claim 5 wherein the pH in (v) is adjusted or increased from a pH of 2.3 to about 6.5 by the addition of a base, and wherein the base is selected from a group of sodium hydroxide, potassium hydroxide, or ammonium hydroxide.

13. A process in accordance with claim 1 wherein the heating of the blend of latex, colorant and surfactants in (iv) is accomplished at temperatures of from about 20° C. to about 5° C. below the Tg of the resin for a duration of from about 0.5 hour to about 6 hours.

14. A process in accordance with claim 1 wherein the latex resin is selected from the group consisting of poly (styrene-butadiene), poly(para-methyl styrene-butadiene), poly(meta-methylstyrene-butadiene), poly(alpha-methylstyrene-butadiene), poly(methylmethacrylate-butadiene), poly(ethylmethacrylate-butadiene), poly (propylmethacrylate-butadiene), poly(butylmethacrylate-butadiene), poly(methylacrylate-butadiene), poly (ethylacrylate-butadiene), poly(propylacrylate-butadiene), poly(butylacrylate-butadiene), poly(styrene-isoprene), poly (para-methyl styrene-isoprene), poly(meta-methylstyrene-isoprene), poly(alpha-methylstyrene-isoprene), poly (methylmethacrylate-isoprene), poly(ethylmethacrylate-isoprene), poly(propylmethacrylate-isoprene), poly (butylmethacrylate-isoprene), poly(methylacrylate-isoprene), poly(ethylacrylate-isoprene), poly (propylacrylate-isoprene), and poly(butylacrylate-isoprene).

15. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

16. A process in accordance with claim 1 wherein the colorant dispersion contains a cationic surfactant of a quaternary ammonium salt.

17. A process in accordance with claim 1 wherein the colorant is carbon black, magnetite, cyan, yellow, magenta, and mixtures thereof, and wherein the functionalized wax has a weight average molecular weight Mw of from about 1,000 to about 20,000.

18. A process in accordance with claim 1 wherein the functionalized wax has a weight average molecular weight Mw of from about 2,000 to about 12,000.

19. A process in accordance with claim 1 wherein the toner isolated are from about 2 to about 15 microns in volume average diameter, and the geometric size distribution thereof is from about 1.15 to about 1.35.

20. A process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally (vii) separating the toner particles, and wherein there is formed in (iv) toner aggregates of from about 1 to about 10 microns in volume average diameter.

21. A process in accordance with claim 1 wherein the nonionic surfactant concentration is from about 0.1 to about 5 weight percent; the anionic surfactant concentration is about 0.1 to about 5 weight percent; and the cationic surfactant concentration is about 0.1 to about 5 weight percent of the toner components of resin, and colorant agent.

22. A process in accordance with claim 2 wherein the nonionic surfactant concentration is about 0.1 to about 5 weight percent of the toner components; and wherein the anionic surfactant concentration is about 0.1 to about 5 weight percent of the toner components.

23. A process in accordance with claim 1 wherein the resin Tg in (iv) is from about 50 to about 80° C.

24. A process for the preparation of toner compositions comprising:

(i) providing, or preparing a latex emulsion comprised of submicron resin particles which are in the size range of between about 0.1 to about 0.4 microns in volume average diameter, in an ionic surfactant and a nonionic surfactant;

(ii) preparing a functionalized wax/colorant dispersion in water, which dispersion is comprised of submicron wax particles which are in the size range of between about 0.1 to about 0.3 microns in volume average diameter, suspended in an aqueous phase containing an ionic surfactant and a nonionic surfactant, a colorant dispersion containing submicron colorant particles suspended in an aqueous phase containing a nonionic surfactant, to which a counterionic surfactant with a charge polarity of opposite sign to the ionic surfactant of employed in the latex is added;

(iii) shearing the functionalized wax/colorant dispersion with a latex comprised of resin, anionic surfactant, nonionic surfactant, and water, thereby causing a flocculation of wax, colorant, and resin in an aqueous media containing anionic, nonionic and cationic surfactants;

(iv) heating the above sheared, flocculated blend at a temperature of from about 5 to about 25° C. below about the glass transition temperature (Tg) of the resin to form toner aggregates and;

(v) adding an anionic stabilizer to the electrostatically formed aggregates, and heating at a temperature of from about 5 to about 50° C. on about 6 to about 35 degrees Centigrade above about the Tg of the resin to provide a toner comprised of resin, functionalized wax, and colorant, and wherein the wax is completely, from about 95 to about 100 percent, incorporated in the toner.

25. A process in accordance with claim 24 wherein said submicron colorant particles are in the size range of between about 0.08 to about 0.3 microns in volume average diameter and are suspended in an aqueous phase containing a nonionic surfactant, and wherein there is further prepared an acidic aqueous solution of a poly aluminum chloride as a coagulating medium, wherein the amount of poly aluminum is from about 1.0 to 3.0 grams, and which is added to an acid solution in the range from about 3.0 to about 10 grams; and shearing the wax/pigment dispersion with a latex comprised of resin, anionic surfactant, nonionic surfactant, and water; thereby causing a flocculation of wax, pigment, resin particles in an aqueous media containing anionic, nonionic surfactants and poly aluminum chloride; heating the resulting sheared, flocculated blend at a temperature of from about 1 to about 10° C. below the glass transition temperature (Tg) of the resin to form toner sized aggregates and; adjusting the pH of the aggregate blend from a pH which is in the range of about 2.3 to 3.8 to a pH of about 6.3 to about 7.0 with the addition of a base; and heating the aggregated particles at a temperature of from about 15 to about 25° C. above about the Tg of the resin to provide a toner composition comprised of resin, functionalized wax, and pigment wherein the wax is total, from about 95 to about 100 percent, incorporated in the toner resulting and (v) cooling, and isolating the toner product.

26. A toner process which comprises mixing (i) a colorant dispersion, a functionalized wax, and (ii) a nonionic surfactant, an ionic surfactant or mixtures thereof, with (iii) a latex comprised of resin and a mixture of anionic surfactant and a nonionic surfactant;

(iv) heating the resulting blend of (iii) about equal to, or below about the glass transition temperature (Tg) of the resin; and (v) optionally adding additional anionic surfactant to the resulting aggregated suspension of (iv);

(vi) heating the resulting mixture of (v) about equal to, or above about the Tg of the resin, and (vii) isolating the toner.

27. A process in accordance with claim 1 wherein the functionalized wax is selected from the group consisting of polypropylene, polyethylene, polyethylene/amide, polyethylene/polytetrafluoroethylene, polethylene/polyethylenetetrafluoroethylene/amide, and mixtures thereof, and wherein said polypropylene and said polyethylene each contains a fluorine, amide imides, esters, quaternary amines, or carboxylic acids on the polymer backbone, and wherein there is added additional anionic surfactant in (v).

28. A process in accordance with claim 1 wherein the temperature in (iv) is in the range of about 60 to 85 degrees Centigrade, or below the melting point of the functionalized wax employed and which wax is an amorphous wax.

29. A toner obtained by the process of claim 26 and comprised of resin, colorant, and functionalized wax.

30. A process in accordance with claim 1 wherein said functionalized wax contains on the polymer selected fluorine, esters, amide imides, carboxylic acids, quaternary amines or mixtures thereof.

31. A process in accordance with claim 1 wherein said functionalized wax is a fluorinated paraffin wax.

32. A process in accordance with claim 1 wherein the functionalized wax is a polypropylene.

33. A process in accordance with claim 1 wherein the latex resin is a poly(styrene butadiene).

34. A process for the preparation of toner which comprises mixing a colorant dispersion, a functionalized wax and a latex, subsequently heating the resulting mixture below about the glass transition temperature of the latex resin, cooling, and thereafter heating the resulting mixture above the glass transition temperature of the latex resin.

35. A process in accordance with claim 34 wherein subsequent to heating above the resin glass transition temperature, cooling is accomplished and the toner is isolated.

36. A process in accordance with claim 34 wherein subsequent to heating below the resin glass transition temperature, there is added additional anionic surfactants.

37. A process in accordance with claim 34 wherein heating below the glass transition resin temperature results in toner aggregates.

38. A process in accordance with claim 34 wherein heating above the resin glass transition temperature results in the coalescence of toner aggregates formed after heating below the glass transition temperature.

* * * * *